United States Patent [19]

Bardsley

[11] Patent Number: 4,790,252

[45] Date of Patent: Dec. 13, 1988

[54] SELECTIVE NEEDLE TUFTING MACHINES

[75] Inventor: H. Brian Bardsley, Euxton, England

[73] Assignee: Spencer Wright Industries, Inc., Dalton, Ga.

[21] Appl. No.: 123,258

[22] Filed: Nov. 20, 1987

[30] Foreign Application Priority Data

Dec. 6, 1986 [GB] United Kingdom ..... 8629241

[51] Int. Cl.[4] ..... D05C 15/06

[52] U.S. Cl. ..... 112/80.4; 112/80.43; 112/266.2

[58] Field of Search ..... 112/80.43, 80.44, 80.4, 112/266.2

[56] References Cited

U.S. PATENT DOCUMENTS

| | | | |
|---|---|---|---|
| 3,259,088 | 7/1966 | Rockholt | 112/80.43 |
| 3,547,058 | 12/1970 | Brown et al. | 112/80.43 |
| 3,752,095 | 8/1973 | Brown et al. | 112/80.43 |
| 3,881,432 | 5/1975 | Dodd et al. | 112/80.43 |
| 3,978,800 | 9/1976 | Carp et al. | 112/80.43 |

*Primary Examiner*—Ronald Feldbaum
*Attorney, Agent, or Firm*—Alan Ruderman

[57] ABSTRACT

A tufting machine has a needle mounting construction including a multiplicity of needle support carriages, each carriage being slidably mounted in guides for controlled movement in a direction normal to the path of reciprocation of the tufting machine push rods. Pneumatic cylinders are operatively connected with each carriage to effect movement in accordance with a predetermined pattern. A pair of needle holders are mounted within each carriage, each holder supporting a needle. The holders have slots for coupling onto a detent reciprocating with the push rods. The carriage may be moved so that one or the other or neither needle holder is coupled to the reciprocating push rods. When a needle holder is coupled, the needle attached thereto reciprocates and may cooperate with a hook to form pile. Each needle of a pair may be threaded with different type yarn so that unique patterning affects may be obtained.

16 Claims, 2 Drawing Sheets

SELECTIVE NEEDLE TUFTING MACHINES

BACKGROUND OF THE INVENTION

This invention relates to tufting machines, and more particularly to a needle arrangement and drive mechanism therefor to select one of at least two needles or neither needle to stitch or skip a stitch in accordance with a pattern.

Controlled needle tufting machines are known in the art for selectively engaging and disengaging, in skip-stitch fashion, various of the needles in accordance with a program during each reciprocatory cycle of the needle driving push rods. Basically these machines render selective needles or groups of needles inoperative while the remainder of the needles are operative to pierce and penetrate the backing fabric upon each stroke of the push rods. Examples of such machines are illustrated in U.S. Pat. Nos. 3,115,856; 3,259,088; 3,881,432 and 3,986,465. Such machines have been very successful, especially for producing bed spreads, and in the case of individually controlled needle tufting machines have been widely accepted for overtufting a design into a pretufted fabric, as described in U.S. Pat. No. 4,693,190.

In these machines each needle cooperates with its own respective loop seizing hook and each hook cooperates with but one needle. However, although it is believed that sometime ago attempts were made to provide a tufting machine wherein one of two needles could be selected to sew with a single loop seizing member on a particular drive stroke or machine cycle, no such machine is known to have been developed or constructed. If such a machine were developed wherein at least one of two needles could be selected to form a stitch in a given row of stitching, the needles could be threaded with different yarns, such as yarns of different color, and for any particular stitch, the color could be selected.

If such a machine is to be successful it is mandatory that the complexity of the mechanism for performing the needle selection and for driving the selected needle must be minimized. Additionally, since there normally would be at least twice as many needles mounted in a given machine as compared to a conventional tufting machine or a conventional controlled needle tufting machine, the needle mounting structure clearly must be compactly arranged.

SUMMARY OF THE INVENTION

Consequently, it is a primary object of the present invention to provide a tufting machine having means for selecting one of at least two needles or neither of the needles to cooperate with a loop seizing member to provide a stitch or skip the stitch in accordance with a pattern, and a needle mounting structure for such a machine.

It is another object of the present invention to provide a tufting machine wherein one of two needles may be selected to pierce a backing material substantially at a particular location in a single row so that a selected needle may cooperate with a single loop seizing member.

It is a further object of the present invention to provide a needle mounting structure for supporting two needles in a tufting machine, the mounting structure being shiftable so that one or neither of the needles may be reciprocably driven by drive means associated with the tufting machine, and the method of mounting and selecting an operative needle.

Accordingly, the present invention provides a needle mounting construction for a tufting machine comprising a needle support carriage moveably mounted in guide means for controlled displacement in a first direction, plural needle means mounted in spaced parallel disposition in said carriage and each selectively reciprocable therein along a path extending in a second direction substantially normal to said first direction and displacement means operatively connected with the carriage and adapted to effect displacement of said carriage according to predetermined patterning requirements, the needle means being selectively cooperable with a drive bar for reciprocable motion in said second direction on displacement of the carriage to one of two positions to select one of the needle means to pierce a backing material and cooperate with loop seizing means in forming pile extending from the backing from yarn carried by a needle supported by the selected one of the needle means, or neither needle means may cooperate with the drive bar upon displacement of the carriage to a third position in which case the backing is not so pierced.

According to a preferred feature of the invention, the needle means are two in number, each carrying a needle, and the separation between the needles corresponds to the extent of displacement of the carriage in moving from cooperative engagement of one needle means and the needle drive bar to that of the other needle means and needle drive bar, or with neither of the needle means and the needle drive bar.

In the preferred form of the invention the needle support carriage comprises a pair of plates spaced apart by spacer means which form slots between the plates and the spacer means for receiving needle holders which carry the needles that pierce the backing material. The carriage and a multiplicity of other carriages are supported in spaced grooves in guide members within which the carriages may be slidably shifted to select the desired needle or neither needle.

By proper selection of design criteria, the reciprocating center line of either selected needle will be the same so that the loop seizing member will seize a loop of yarn at the same location whether one or the other needle is selected.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
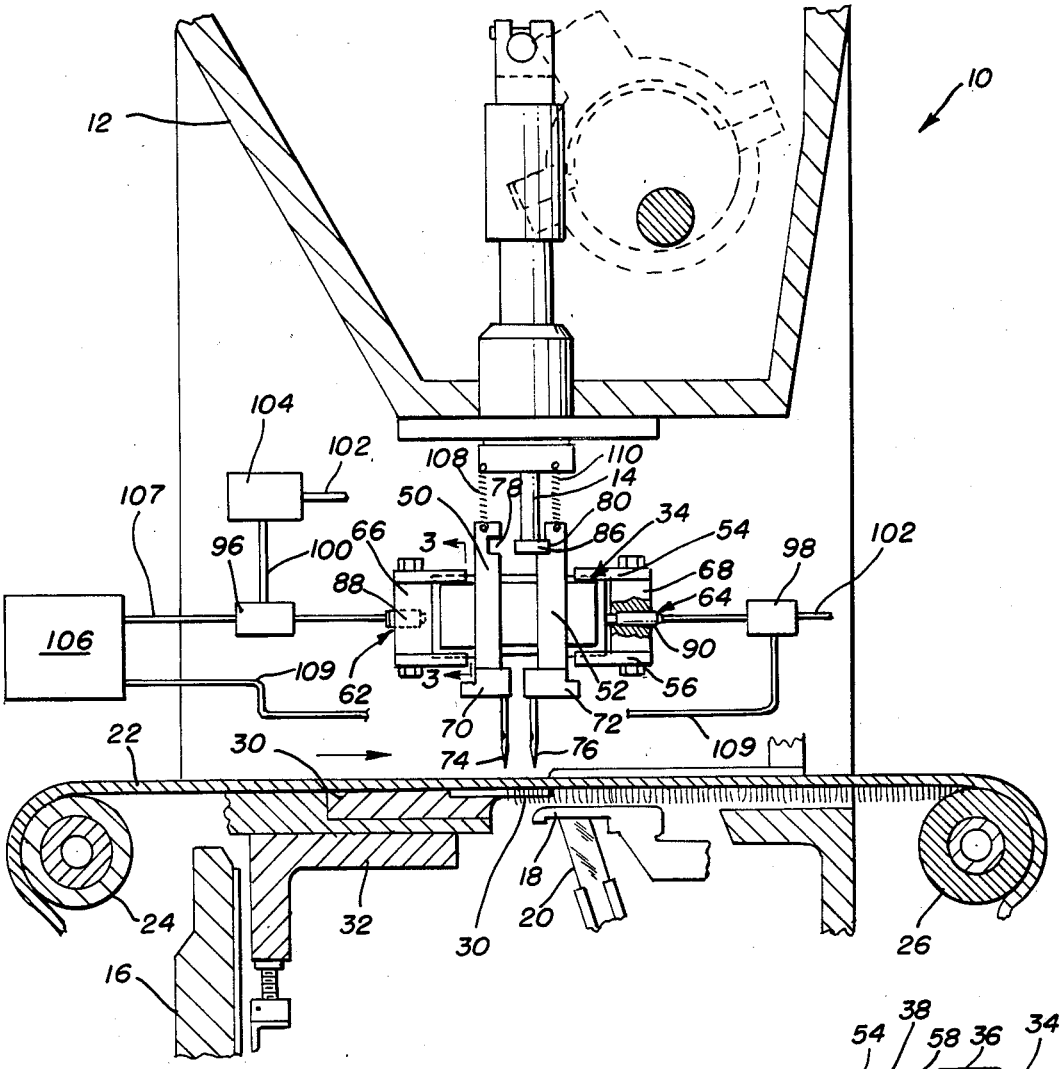
FIG. 1 is a diagrammatic vertical cross sectional view taken transversely through a tufting machine incorporating a needle drive constructed in accordance with the principles of the present invention.

Referring now to the drawings, a portion of a tufting machine 10 is illustrated, the machine having a head 12 within which is mounted drive mechanism for reciprocably driving a plurality of push rods 14 (only one of which is illustrated), the drive mechanism being conventional drive means such as that illustrated in the aforesaid U.S. patents disclosing controlled needle machines. Additionally, the tufting machine conventionally includes a bed 16 disposed beneath the head, and within which is mounted a loop seizing member such as a multiplicity of hooks 18 (only one of which is illustrated) which oscillate in timed relationship to the reciprocation of the push rods to receive loops of yarn from a needle driven by the push rods 14 as hereinafter described. Each hook 18 preferably has a cooperating knife 20 acting in conjunction therewith so that loops seized by the hook may be cut to form cut pile. A backing material 22 is fed through the tufting machine by roller means 24, 26, the backing material being fed over needle plate fingers 28 carried by a needle plate 30 supported on an adjustable bed plate 32.

Figure 2:
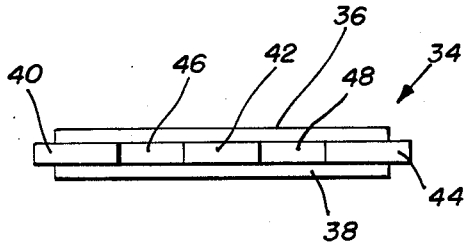
FIG. 2 is a plan view of a needle support carriage illustrated in FIG. 1, but removed from the machine.
Figure 3:
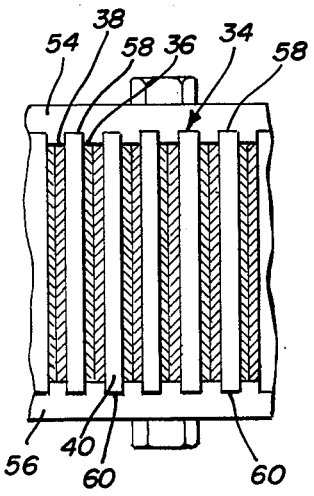
FIG. 3 is a cross sectional view taken substantially along line 3—3 of FIG. 1.
Figure 4:
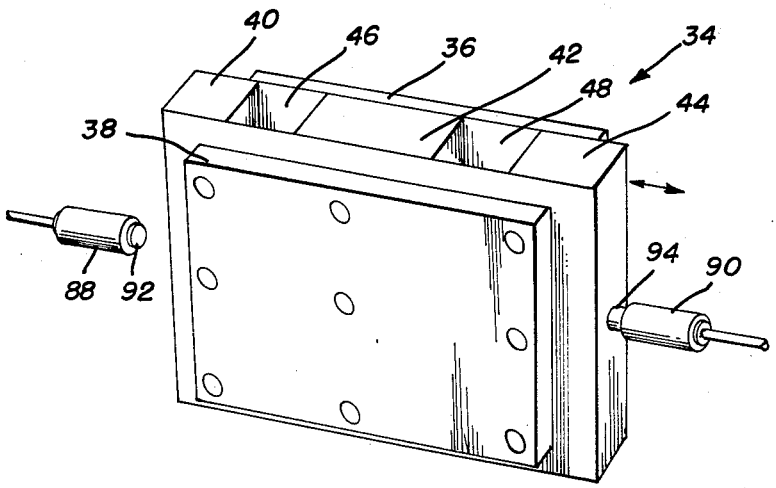
FIG. 4 is an enlarged perspective view of a needle support carriage.

Mounted in the head for carrying needles for selective cooperation with the respective hook 18 as hereinafter described is a multiplicity of needle carriages 34. As best seen in FIGS. 2, 3 and 4, each carriage 34 comprises a pair of rigid rectangular sheets 36, 38 separated by spacers 40, 42, 44 to define elongated slots 46, 48 therebetween, each slot being intended slidably to receive a respective needle holder 50, 52 therein, the elements 36, 38, 40, 42, 44 being riveted, spot welded or otherwise secured together. The carriages 34 are arranged in vertical disposition in the plane thereof in fixed guide rails 54, 56 having respective grooves 58, 60 formed therein within which each carriage may slide. The guides 54, 56 are provided for engagement by the upper and lower edges of the carriages 34 at each end thereof, the rigid sheets 36, 38 being sized for engagement with the guides while the outer spacers 40, 44 are extended for receipt within the grooves 58, 60 respectively. Preferably there are a pair of needle holders 50, 52 slidably mounted in each of the carriages for movement in the respective parallel slots 46, 48, and the push rod 14 is selectively engageable with one or the other of the needle holders 50, 52 according to the position of the respective carriage in the guides 54, 56. The arrangement further includes respective displacement means 62, 64 carried in supports 66, 68 secured to the end frame of the machine and operable on each carriage 34 to move the same in the guides 54, 56 between at least first and second positions, and preferably first, second and third positions. Each needle holder 50, 52 carries a respective needle bar 70, 72 within which a respective needle 74, 76 is secured. In the first position one of the needle holders 50, 52 is in operative engagement with the push rod 14 and in the second position the push rod is in operative engagement with the other needle holder. Each hook 18 is provided for cooperative engagement with a selected one of the respective needles 74, 76 for seizing a loop of yarn carried thereby upon reciprocation of the needle through the backing fabric 22 fed through the machine. In the third position the push rod cooperates with neither of the needle holders and thus neither needle cooperates with the hook.

Each needle holder 50, 52 comprises a flat elongated element dimensioned so as to have a free sliding fit in the respective slot 46, 48 in the carriage, the needle holders being of a length such that they extend from the carriage 34 both above and below the same. A cut-out 78, 80 is provided in corresponding positions in the inwardly facing edges of the respective needle holders 50, 52, and adjacent the upper extremities thereof, the cut-outs 78, 80 being dimensioned for engagement by a respective one of two detents 82, 84 provided at opposite sides of the lower end of the push rods 14. The detents 82, 84 may be formed by a rectangular bar 86 secured to the bottom of the push rods 14 and extending the length of the machine whereby engagement of the cut-outs 78, 80 of all of the needle holders 50, 52 may readily occur as hereinafter described.

In the construction illustrated, the separation of the needle holders 50, 52 existing in a common plane coincident with that of the carriages 34 exceeds the dimension of the push rods and the corresponding dimension of the bar 86 carried thereby in the region of the detents 82, 84, so that the bar 86 may pass therebetween.

The displacement means 62, 64 need only be provided at one side only of the carriages 34 and operate on the edge of a spacer 40 or 44 to move the carriage between the first and second positions, and preferably the third position in the guides 54, 56 according to predetermined patterning requirements. However, for more positive control, the displacement means may be provided at each side of the carriage, such means being the illustrated displacement means 62, 64. Conveniently each of the means 62, 64 may comprise pneumatic or other fluid cylinders 88, 90 operable on the respective carriage 34 through respective pins 92, 94 or the like, preferably biased into the respective cylinder 88, 90 or biased out to an intermediate position. Acutation of the respective pins 92, 94 is controlled by, for example, air fed through respective electrically controlled pneumatic valves 96, 98 from conduits 100, 102 communicating with a compressor 104, the valves permitting air to flow as determined by a pattern controller 106, which preferably is a computer driven control system loaded with pattern information from a floppy disk or the like, and provides electrical signals to the valve through leads 107, 109.

In operation, considering only one of the carriages 34, upon actuation of one or the other of the cylinders 88, 90, the carriage 34 will assume a corresponding position in the guides 54, 56 and a selective one of the needles 74, 76 may be operatively coupled with the push rod 14 by engagement of the respective detent 80, 84 of the detent bar 86 with the appropriate cut-out 78, 80 in the respective needle holder 50, 52. Reciprocation of the push rod 14 will thereafter move the selected needle 74, 76 downwardly against the restraint of a respective return spring 108, 110 and cause the needle to penetrate the backing material 22, the selected needle cooperating with the hook 18 which seizes a loop of yarn upon withdrawal of the needle from the backing material in conventional manner.

The carriage preferably remains in position relative to the guides 54, 56 in which it is mounted until it is required to create loops of yarn from yarn carried by the non-selected needle, or when no loops are desired to be formed. At that time the other cylinder 88, 90 is actuated to bring the newly selected needle into the position previously occupied by the operative needle along the same center line, thus disengaging the one detent 82, 84 from the adjacent needle holder 50, 52 and bringing the opposite detent into operative engagement with the needle holder carrying the newly selected needle, or in the case where neither needle is desired to be selected, disengaging the detent from the needle holder carrying the previously selected needle by moving the carriage to a position wherein the detent bar 86 may freely reciprocate in the space between the two needle holders 50, 52. When the second needle is selected for reciprocation and its needle holder is coupled to the detent bar 86 by means of the detent with its cut-out 78, 80, the newly selected needle operates to form loops by moving in the same reciprocating path as that followed by the first selected needle so that the position at which the hook 18 seizes a loop remains constant. As will readily be appreciated, by selecting one or the other needle 74, 76 for loop forming reciprocation according to the preselected sequence, the nature of the yarn used for forming loops at a given position in the backing can be varied accordingly. For example, the yarn carried by needle 74 may be a different color from that carried by needle 76, or the type of yarn, including the thickness thereof may be different in the needle 74 than in the needle 76. Of course other variations in the type of yarn threaded in the needles may readily occur by those skilled in the art.

Figure 5:
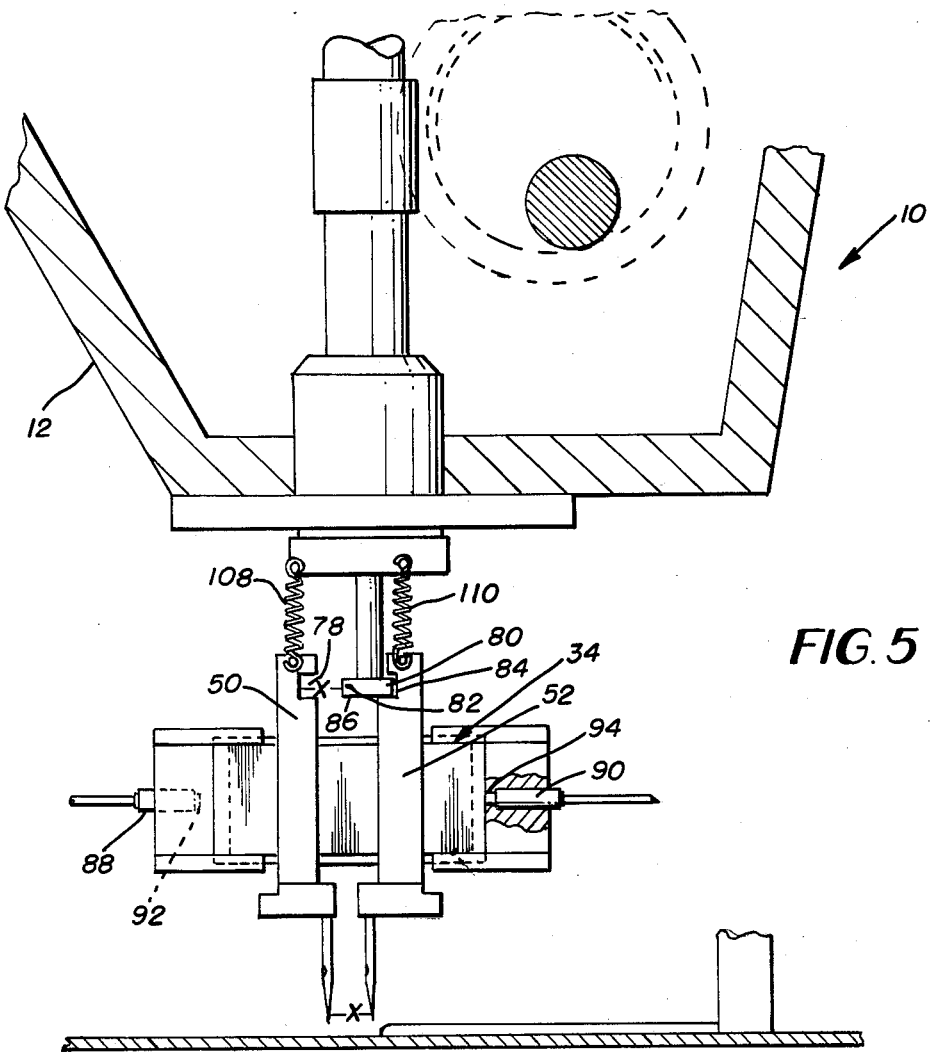
FIG. 5 is an enlarged fragmentary view of a portion of the machine illustrated in FIG. 1.

Although the push rods 14 may be engaged with one or the other needles 74, 76 so that a loop may be formed during each reciprocation cycle of the machine, and this may be a desirable feature, as aforesaid it is preferable that the additional feature of having neither needle selected during a particular cycle provides greater flexibilty to the machine and provides it with the stitch, no-stitch advantage of the controlled needle machines disclosed in the aforesaid patents. Thus, as disclosed, the detent bar reciprocates along a central line of reciprocation and one or the other of the needle holders 50, 52 may be moved by the respective displacement means 62, 64 to engage the detent bar at that position. As illustrated in FIG. 5 the distance "X" between the needles is substantially the same as the distance from the inner portion of a cut-out 78, 80 to the adjacent detent 82, 84 when the other detent is within the cut-out of the other needle holder. Accordingly, the amount of shift of a carriage 34 to select either of the needles is relatively small, and by proper design of the detents and the detent bar only a small amount of movement would be required to position the detent bar between the two needle holders. Additionally, the amount of reciprocation is reasonably small so that by proper design of the needle holders, including the cut-outs, and of the carriages, the detent bar may readily reciprocate between the two needle holders without interference therewith. Of course, if only one or the other of the needles is desired to be engaged rather than neither of the needles, one of the needles may be located along the line of reciprocation of the push rod and detent bar and be cooperatively engaged therewith, such needle being shifted from that position on selection of the other needle.

It should be understood that there would be a multiplicity of carriages 34 extending across the machine, with each carriage carrying a pair of needles Thus, the selection of a needle or the non-selection thereof at each station would be individually controlled so that across the backing material yarn loops of the various type yarns may be inserted at each station, or alternatively at selected stations no loops would be inserted. In this manner a substantial number of patterning effects may be produced in the backing material as each operating needle coacts with a respective hook 18 for forming and seizing the loop, and the respective knife 20 acts to cut the loop to form cut pile.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a tufting machine having a head for mounting drive means for reciprocating in a linear path, apparatus for mounting at least a pair of needles for selective coupling of one of said needles to said drive means, a bed disposed beneath the head and having loop seizing means for seizing loops of yarn presented by said needles, said apparatus comprising guide means fixedly supported in said machine, a needle support carriage mounted in said guide means for movement in a direction transverse to said path, said needle support carriage having a pair of spaced apart elongated slots extending parallel to said path, an elongated needle holder mounted in each of said slots for reciprocation therein, means for supporting a needle from one end of each of said needle holders extending toward said loop seizing means, biasing means for urging said needle holders away from said loop seizing means, coupling means associated with said drive means and with each of said needle holders for selective coupling and uncoupling of said needle holders with said drive means, displacement means engageable with said carriage for moving said carriage between at least first and second positions, said first position being defined as that where one of said needle holders is disposed for coupling to said drive means, and said second position being defined as that where the other of said needle holders is disposed for coupling to said drive means, and control means for actuating said displacement means in accordance with a preselected pattern to selectively move said carriage to said first and second positions for coupling said needle holders to said drive means to overcome the respective biasing means and reciprocatably drive a selected needle for cooperation with said loop seizing means.

2. In a tufting machine as recited in claim 1, wherein said displacement means is engageable with said carriage for moving said carriage between said first and second positions, and additionally a third position, said third position being defined as that where neither needle holder is disposed for coupling to said drive means, so that selectively either or neither needle may be reciprocably driven.

3. In a tufting machine as recited in claim 1, wherein said carriage comprises first and second plates spaced apart by a plurality of spacer members, said spacer members being spaced apart such that said plates and said spacer members define said elongated slots

4. In a tufting machine as recited in claim 3, wherein said guide means comprises first and second guide rails spaced apart one from the other in planes transverse to said path, said guide rails having opposed facing guide grooves formed therein for slidably receiving said carriage therebetween for slidable movement

5. In a tufting machine as recited in claim 4, wherein there are a multiplicity of corresponding guide grooves formed in each of said rails for receiving a multiplicity of carriages therebetween, each carriage receiving a pair of needle holders, each of said needle holders having means for supporting a respective needle, and a loop seizing means corresponding to each pair of needles.

6. In a tufting machine as recited in claim 5, including displacement means associated with each carriage for selectively moving each carriage independently of the remaining carriages in accordance with a pattern.

7. In a tufting machine as recited in claim 6, wherein each of said displacement means is engageable with a respective carriage for moving said respective carriage between a position corresponding to said first and second postions, and additionally a third position defined as that where neither needle holder in the respective carriage is disposed for coupling to said drive means.

8. In a tufting machine as recited in claim 4, wherein said plates are shorter than said spacer members in the direction of elongation of said slots, and said spacer members slide in said grooves.

9. In a tufting machine as recited in claim 3, wherein said guide means comprises a pair of first and second guide rails spaced apart in planes transverse to said path at each transverse side of said path, each pair of guide rails having opposed facing guide grooves aligned with similar guide grooves in the other pair of rails for slidably receiving said carriage within corresponding pairs of grooves in each pair of guide rails.

10. In a tufting machine as recited in claim 9, wherein said plates are shorter than said spacer members in the direction of elongation of said slots, and said spacer members slide in said grooves.

11. In a tufting machine as recited in claim 9, wherein there are a multiplicity of corresponding guide grooves formed in each pair of said rails for receiving a multiplicity of carriages, each carriage receiving a pair of needle holders, each of said needle holders having means for supporting a respective needle, and a loop seizing means corresponding to each pair of needles.

12. A method of tufting pile from first and second yarns selectively in the same row of stitching comprising, supporting and feeding a base material in one direction, mounting first and second needles on one side of said base material, each needle carrying a respective one of said yarns, supporting on the opposite side of said material a hook for seizing a loop of yarn presented by said needles selectively, mounting a reciprocating drive member on said one side for reciprocation in a path toward and away from said backing, selectively moving said needles in a direction transverse to said path, and selectively coupling one of said needles to said drive means for reciprocation therewith for penetrating said material and cooperating with said hook.

13. In the method as recited in claim 12, wherein said needles are slidably moved transversely to said path.

14. In the method as recited in claim 12, including a multiplicity of first and second needles spaced transversely to said first direction, and a multiplicity of hooks corresponding to each first and second needle, said method comprising selectively reciprocating a multiplicity of selected first or second needles.

15. A needle mounting carriage for use in a tufting machine, said carriage comprising first and second elongated plates, a plurality of spacer members for spacing said plates apart, said spacer members being spaced apart one from the other in a direction transverse to the direction in which said plates are spaced apart for forming a pair of spaced apart elongated slots disposed intermediate said plates and said spacer members, each of said slots providing a channel for receiving a needle carrying needle holder therein.

16. A needle mounting carriage as recited in claim 13, wherein said plates are shorter than said spacer members in the elongation direction of said slots.

* * * * *